US005868019A

United States Patent [19]

Grabbe

[11] Patent Number: 5,868,019

[45] Date of Patent: Feb. 9, 1999

[54] FEED SYSTEM IN A STAMPING AND FORMING MACHINE HAVING A QUICK RELEASE

[75] Inventor: Dimitry Grabbe, Middletown, Pa.

[73] Assignee: The Whitaker Corporation, Wilmington, Del.

[21] Appl. No.: 825,011

[22] Filed: Mar. 26, 1997

[51] Int. Cl.[6] ..... B21B 33/02

[52] U.S. Cl. ..... 72/4; 72/420; 226/37; 192/125 B

[58] Field of Search ..... 72/3, 4, 338, 420, 72/441, 444, 405.06, 431; 226/24, 27, 33, 37, 55, 57; 172/125 A, 125 B, 125 C, 125 E, 125 F, 125 R, 126, 129 R, 134, 144, 150

[56] References Cited

U.S. PATENT DOCUMENTS

| | | | |
|---|---|---|---|
| 2,656,906 | 10/1953 | Van Haandel | 192/129 R |
| 3,077,966 | 2/1963 | Cohn | 192/125 B |
| 4,023,044 | 5/1977 | Miller et al. | 72/4 |
| 4,489,871 | 12/1984 | Bakermans et al. | 226/52 |
| 4,497,196 | 2/1985 | Bakermans et al. | 72/405 |
| 4,579,201 | 4/1986 | Tiedeman | 192/144 |
| 4,821,556 | 4/1989 | Bakermans et al. | 226/57 |
| 4,887,452 | 12/1989 | Bakermans | 72/420 |

*Primary Examiner*—Joseph J. Hail, III
*Assistant Examiner*—Ed Tolan

[57] ABSTRACT

A stamping and forming machine (10) is disclosed having a feed mechanism for incrementally feeding a strip of material (32) along a feed path and momentarily stopping the strip in proper position within tooling (20, 22) during the stamping and forming operation. The feed system includes a feed drum (36) and is arranged to move between a driving position where the feed drum (36) is in engagement with the strip of material (32) for effecting the movement thereof along the feed path and a remote position out of feeding engagement therewith. A misfeed detection and feed release mechanism is provided for moving the feed drum (36) from the driving position to the remote position upon detection of a misfeed where the strip of material (32) is displaced from the proper position. The feed drum (36) is spring loaded toward the remote position. A first sear (190) is in engagement with the feed drum so that it is held in the driving position against the urging of the spring (174). Second and third sears (216, 218) are coupled to the upper tooling module (22) and movable upon detection of a misfeed into moving engagement with the first sear (190) so that the feed drum (36) is quickly moved to its remote position.

24 Claims, 10 Drawing Sheets

FEED SYSTEM IN A STAMPING AND FORMING MACHINE HAVING A QUICK RELEASE

The present invention relates to feed systems for high speed stamping and forming machines and more particularly to such feed systems capable of quick release in the event of a misfeed or other malfunction.

BACKGROUND OF THE INVENTION

In stamping and forming machines, a strip of stock is fed between upper and lower tooling modules that perform operations on the strip at progressive stages of the feed cycle. This requires that the strip be accurately positioned at each stage. Pilot holes or notches are usually cut in the strip in the first stage of operation that are then used in subsequent stages to accurately align the strip. Should the strip misfeed and the machine continue to run, severe damage can occur to the tooling in the upper and lower tooling modules and the machine itself may be damaged. Various devices have been developed to detect strips that are misfed, including optical and mechanical. Once a misfeed is detected, a clutch in the drive unit is deactivated and a brake engaged. With relatively slow machines, up to the 1400 strokes per minute range, this procedure is adequate, allowing the machine to come to a complete halt in less than 180 degrees of rotation without substantial risk of damage to the tooling or the machine. In the case of a high speed machine, on the other hand, operating at about 3000 strokes per minute or higher, the machine may not be able to be stopped in time to avoid damage once a misfeed is detected. Other devices that have been developed to cope with this problem mechanically disconnect the feed system so that, as the machine is coasting to a stop, the problem is not further aggravated by the feed system continuing to feed stock into the tooling. However, such feed release systems react too slowly for reliable use with a stamping and forming machine operating at high speed. Since machines with clutch and brake drives are not able to stop within 180 degrees of rotation, it is desirable to at least stop the strip feed. However, feed mechanisms are mechanically coupled to the press drive and cannot be quickly stopped when the press is operating at 3000 or more cycles per minute.

What is needed is a feed mechanism having a release system for use in a high speed stamping and forming machine that, upon detection of a misfeed, will reliably disengage the feed mechanism within one half of a single ram stroke cycle.

SUMMARY OF THE INVENTION

A stamping and forming machine is disclosed having a frame, a bolster plate attached to the frame, a ram arranged for reciprocating motion within the frame in a first direction toward the bolster plate and in a second direction away therefrom. Tooling is provided having a first tool module attached to the ram and a second tool module attached to the platen matable with the first tool module for performing a stamping and forming operation on a strip of material. The stamping and forming operation occurs upon movement of the ram in the first direction. A feed mechanism is provided for incrementally feeding the strip of material along a feed path and momentarily stopping the strip in proper position within the tooling for the stamping and forming operation. The feed system includes a drive member coupled to the frame which is arranged to move between a driving position where the drive member is in engagement with the strip of material for effecting the movement thereof along the feed path and a remote position out of engagement therewith. A misfeed detection and feed release mechanism is provided for moving the feed member from the driving position to the remote position upon detection of a misfeed where the strip of material is displaced from the proper position. The misfeed detection and feed release mechanism includes a resilient means for urging the drive member toward the remote position and first and second sears. The first sear is coupled to the frame and movable between a first position in coupled engagement with the drive member so that the drive member is held in the driving position against the urging of the resilient means, and a first tripped position where the first sear is out of coupled engagement with the drive member so that the drive member is free to move toward the remote position under the urging of the resilient means. The second sear is coupled to the upper tooling module and movable from a second position spaced from the first sear to a second tripped position wherein the second sear abuttingly engages and moves the first sear to the first tripped position only upon detection of the misfeed.

DESCRIPTION OF THE PREFERRED EMBODIMENT

Figure 1:
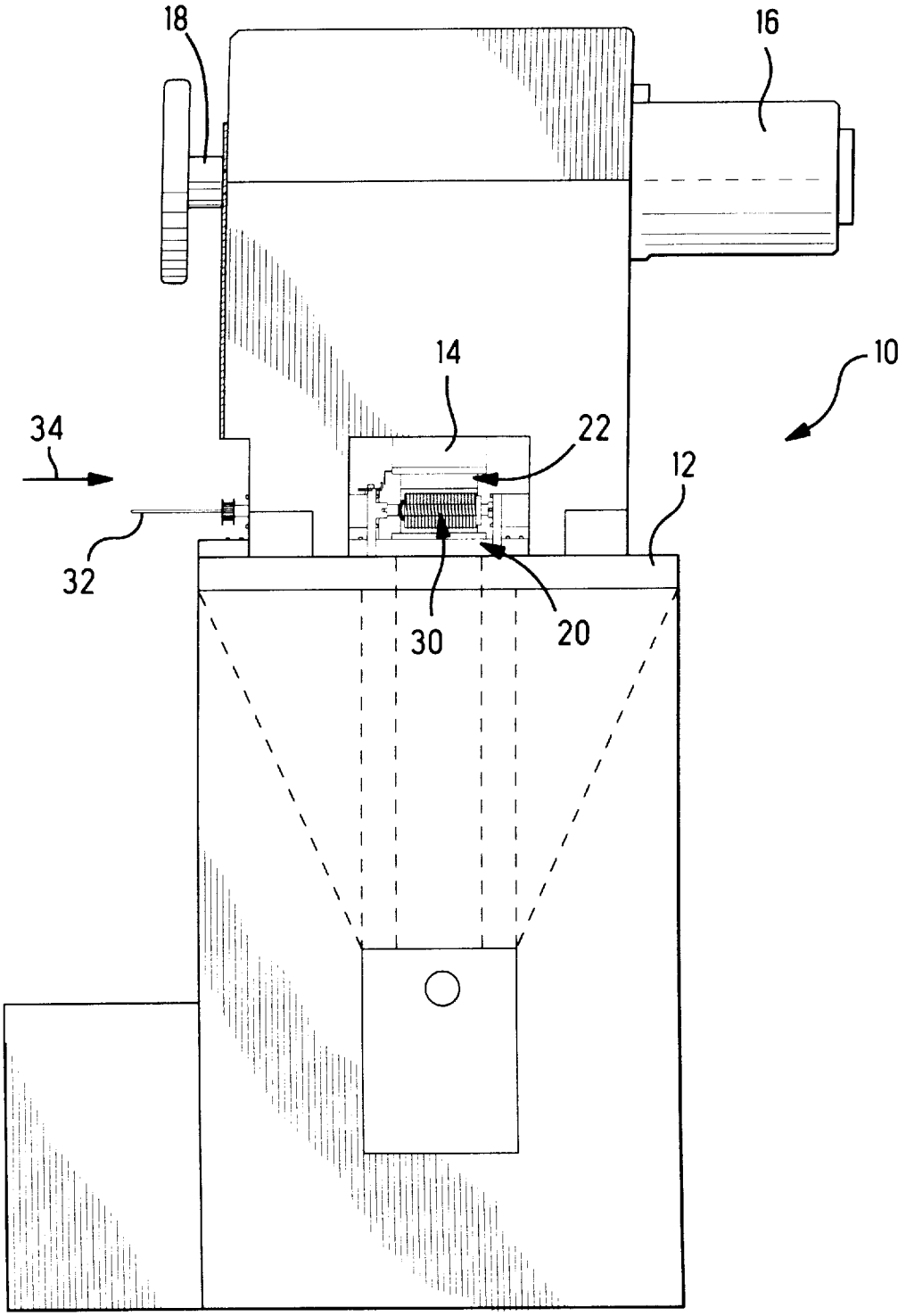
FIG. 1 is a front view of a stamping and forming machine incorporating the teachings of the present invention.

There is shown in FIG. 1 a stamping and forming machine 10 having a bolster 12 and a ram 14 arranged to undergo reciprocating motion toward and away from the bolster. The ram 14 is driven by a motor 16 through a drive shaft 18 in the usual manner. Lower and upper tooling modules 20 and 22 are secured to the bolster 12 and ram 14, respectively, by any suitable means such as clamps or bolts. A feed mechanism 30 is arranged adjacent the upper and lower tooling modules for incrementally feeding a strip of material 32 through the tooling in the direction of the arrow 34, as shown in FIG. 1.

Figure 2:
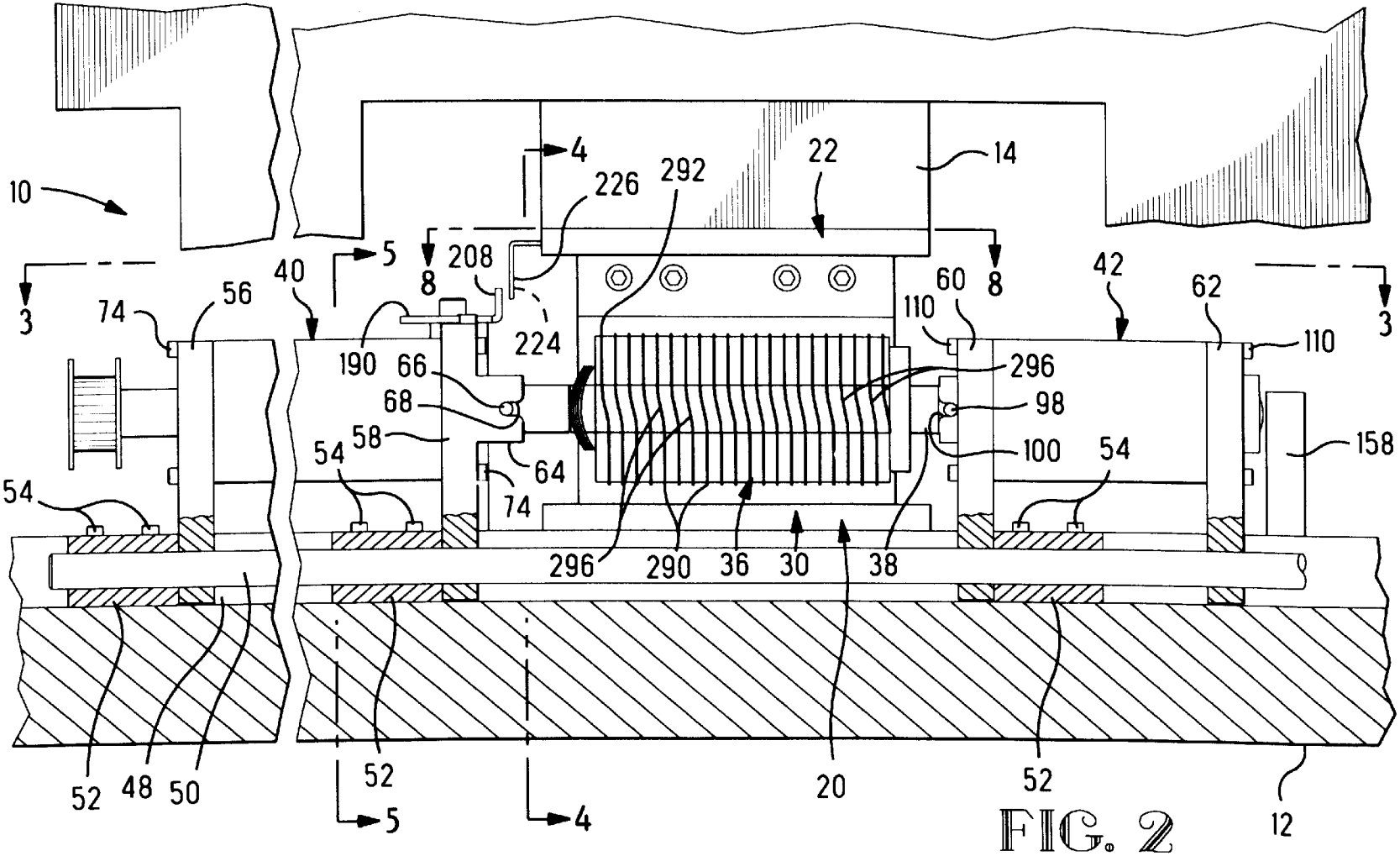
FIG. 2 is an enlarged view of the feed mechanism shown in FIG. 1.
Figure 3:
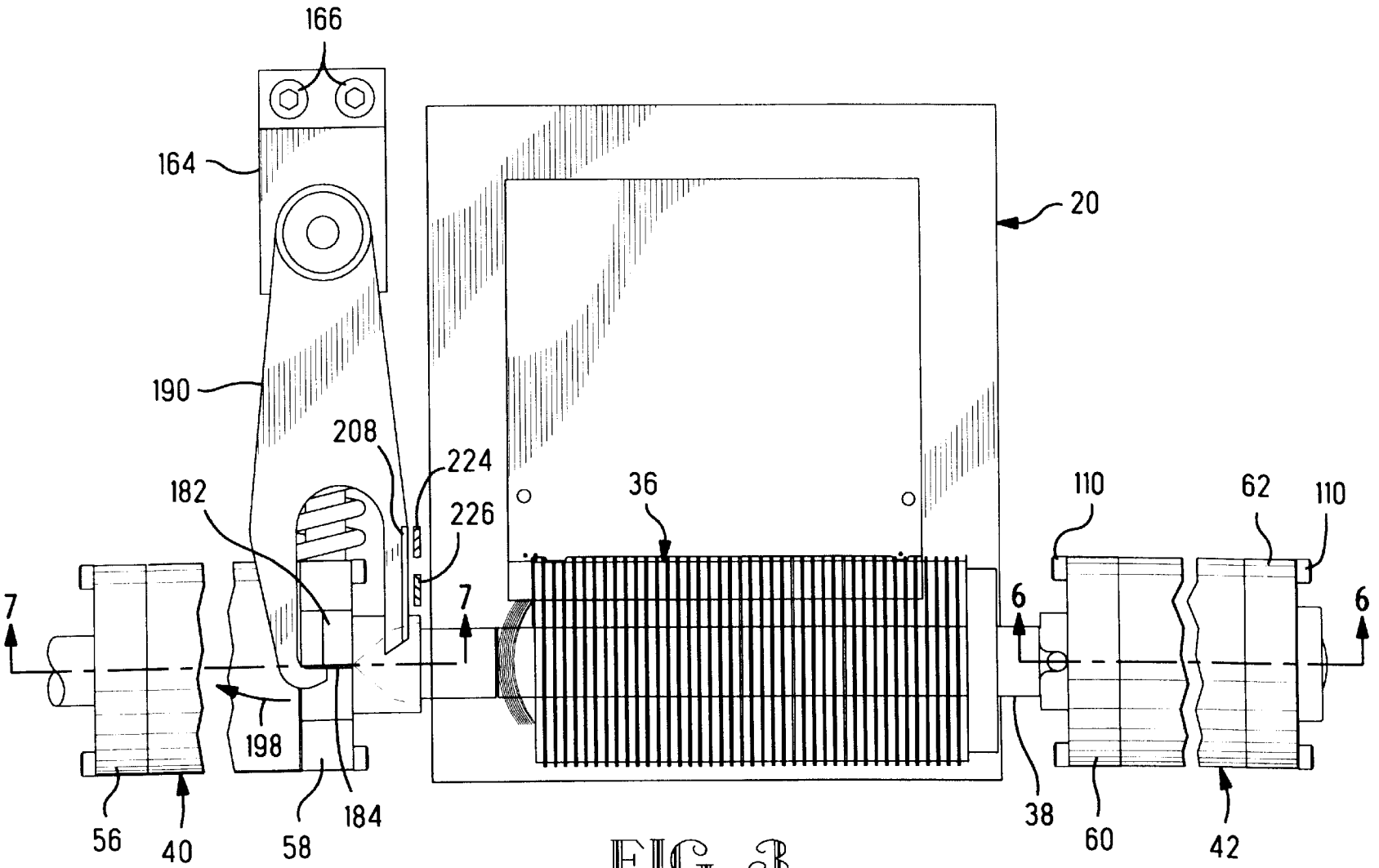
FIG. 3 is a cross-sectional view taken along the lines 3—3 in FIG. 2 showing a top view of the feed mechanism.
Figure 7:
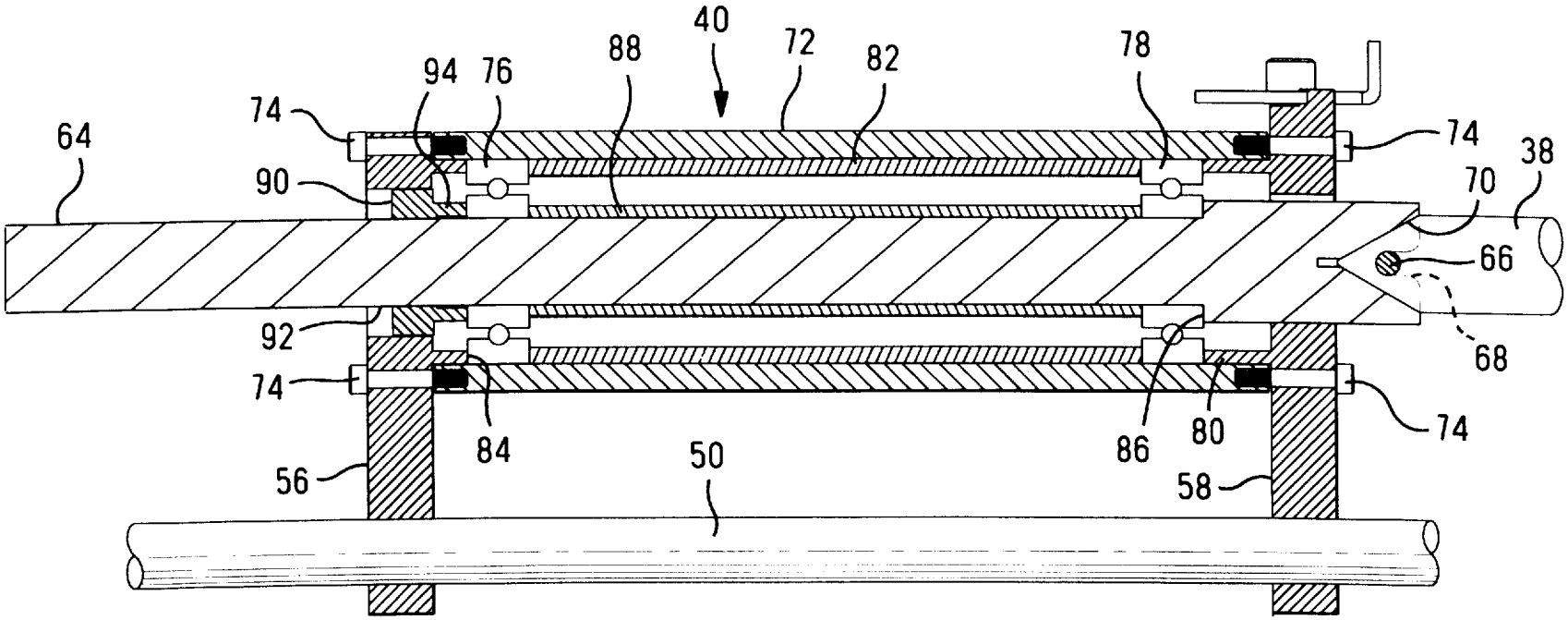
FIG. 7 is a cross-sectional view taken along the lines 7—7 in FIG. 3.

As best seen in FIGS. 2 and 3, the feed mechanism 30 includes a feed drum 36 rigidly attached to a spindle 38, a drive shaft assembly 40, and an idler shaft assembly 42. A pivot shaft 50 is positioned within a groove 48 formed in the bolster 12 and is supported in pillow blocks 52 which are attached to the bottom of the groove by means of screws 54 that extend through clearance holes in the pillow blocks and into threaded holes in the bolster. The drive shaft assembly 40 includes left and right uprights 56 and 58, respectively, which extend downwardly into the groove 48 and are rigidly attached to the pivot shaft 50 by means of a keyway and key, not shown. Similarly, the idler shaft assembly 42 includes left and right uprights 60 and 62, respectively, which extend downwardly into the groove 48 and are rigidly attached to the pivot shaft 50 by means of a keyway and key. The drive shaft assembly 40, as best seen in FIGS. 2 and 7, includes a drive shaft 64 which is drivingly coupled to the feed drum spindle 38 by means of a drive pin 66 extending through a conical end of the spindle and a notch 68 formed in the end of the drive shaft. A conical opening 70 is formed in the end of the drive shaft to receive and accurately center the feed drum spindle 38. The left and right uprights 56 and 58 are attached to an outer sleeve 72 by means of screws 74 that extend through clearance holes in the uprights and into threaded holes in the ends of the sleeve. As best seen in FIG. 7, the drive shaft 64 is journaled for rotation within the sleeve by means of left and right ball bearings 76 and 78, respectively. The right upright 58 includes a cylindrical-shaped projection 80 against which the outer race of the right bearing 78 rests. A spacer sleeve 82 extends within the interior of the outer sleeve 72 from the outer race of the right bearing 78 to the outer race of the left bearing 76 for proper spacing of the two bearings. Another cylindrical-shaped projection 84 extends inwardly from the left upright to engage the outer race of the left bearing 76 and to prevent axial movement of the two bearings. The inner race of the right bearing 78 is against a shoulder 86 formed in the drive shaft 64, as shown in FIG. 7. The drive shaft 64 extends through a spacer sleeve 88 that extends between the inner races of the left and right bearings as shown. A nut 90 is threaded onto a threaded portion 92 of the drive shaft and includes an extended portion 94 that abuttingly engages the inner race of the left bearing 76. The nut is tightened sufficiently to secure the drive shaft 64 to the inner races of the bearings 76 and 78 and to eliminate end play and provide a pre-load, if required.

Figure 5:
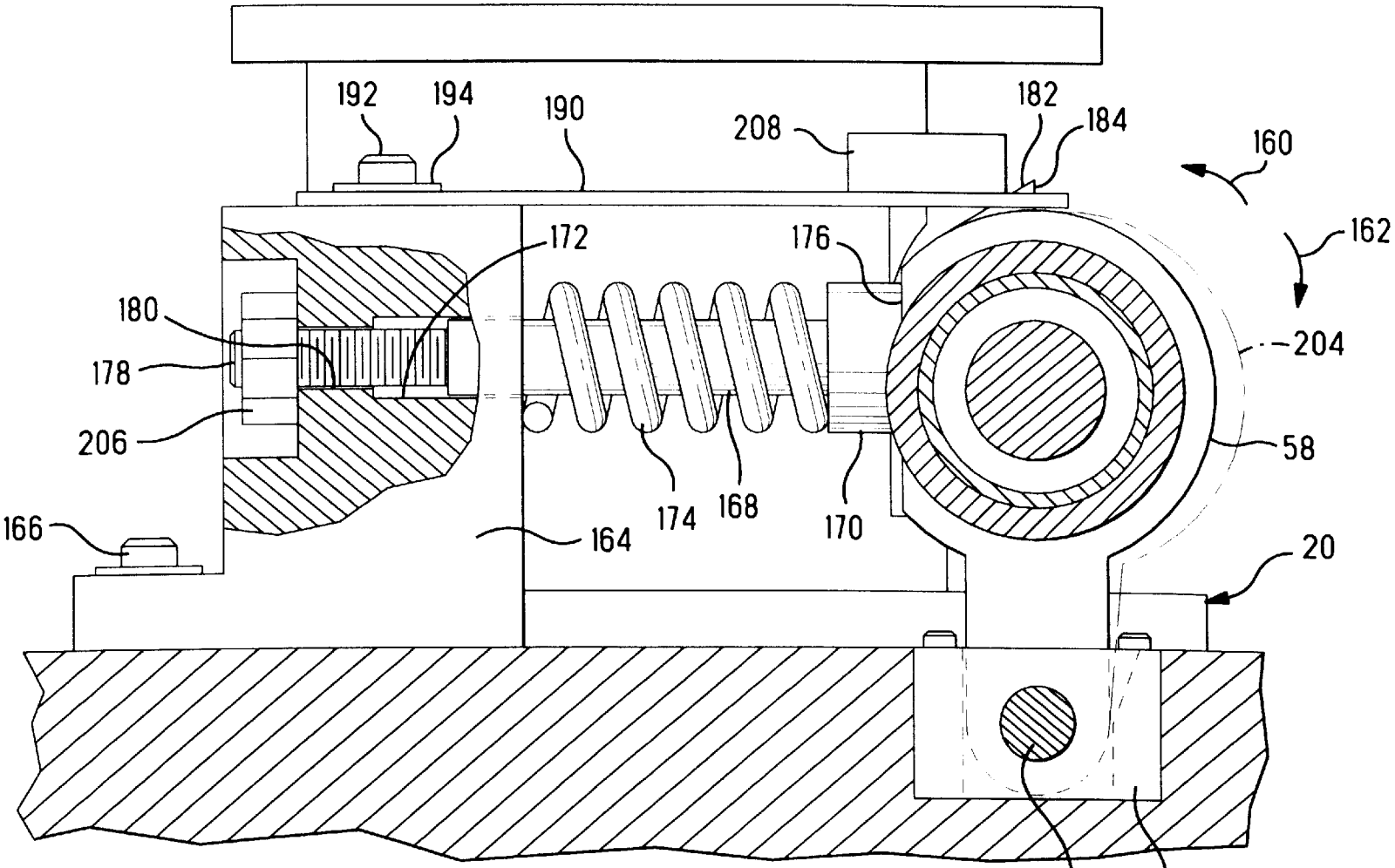
FIG. 5 is a cross-sectional view taken along the lines 5—5 in FIG. 2.
Figure 6:
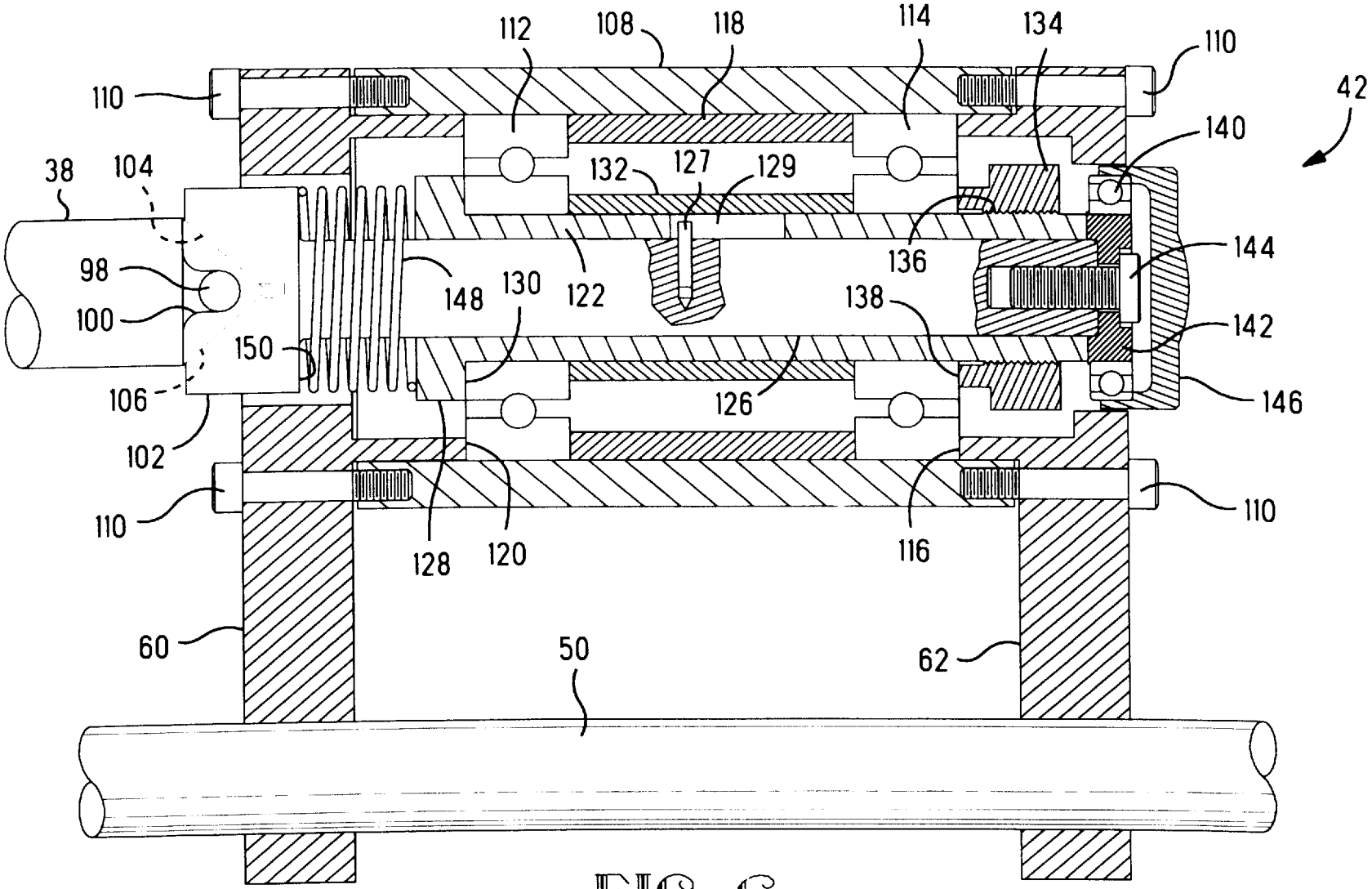
FIG. 6 is a cross-sectional view taken along the lines 6—6 in FIG. 3.

As best seen in FIGS. 2 and 6, The idler shaft assembly 42 includes an idler shaft 102 which is drivingly coupled to the feed drum spindle 38 by means of a drive pin 98 in engagement with a notch 100 formed in the end of the idler shaft. A conical opening 104 formed in the idler shaft mates with a conical end 106 formed on the end of the feed drum spindle. The left and right uprights 60 and 62 are attached to an outer sleeve 108 by means of screws 110 that extend through clearance holes in the uprights and into threaded holes in the ends of the sleeve. As best seen in FIG. 6, the idler shaft 102 is journaled for rotation within the sleeve by means of left and right ball bearings 112 and 114, respectively. The right upright 62 includes a cylindrical-shaped projection 116 against which the outer race of the right bearing 114 rests. A spacer sleeve 118 extends within the interior of the outer sleeve 108 from the outer race of the right bearing 114 to the outer race of the left bearing 112 for proper spacing of the two bearings. Another cylindrical-shaped projection 120 extends inwardly from the left upright 60 to engage the outer race of the left bearing 112 and to prevent axial movement of the two bearings. A hollow shaft 122 includes an inside diameter 124 that is a slip fit with a reduced diameter 126 of the idler shaft 102 so that the idler shaft is free to move axially with respect to the idler shaft assembly 42. Relative rotational movement between the hollow shaft 122 and the idler shaft 102 is prevented by means of a pin 127 projecting from the side of the idler shaft and extending into an elongated opening 129 formed in the hollow shaft parallel to the axis of the hollow shaft. The hollow shaft 122 includes an enlarged end 128 having a shoulder 130 which is positioned against the inner race of the left bearing 112. The hollow shaft 122 extends through a spacer sleeve 132 which extends between the two inner races. A nut 134 is threaded onto a threaded portion 136 formed on the end of the hollow shaft 122, as shown in FIG. 6, and includes an extended portion 138 that abuttingly engages the inner race of the right bearing 114. The nut is tightened sufficiently to secure the hollow shaft 122 to the inner races of the bearings 112 and 114 and to eliminate end play and provide a pre-load if required. The inner race of a thrust bearing 140 is pressed onto a disk-shaped support member 142 that is secured to the end of the idler shaft 102 by means of a screw 144 that extends through a clearance hole in the support member and into a threaded hole in the end of the idler shaft, as best seen in FIG. 6. An end cap 146 includes a shallow bore that closely receives the outer race of the thrust bearing 140, for a purpose that will be explained. The reduced diameter 126 of the idler shaft 102 extends through a compression spring 148 that is disposed between the end 128 of the hollow shaft and a shoulder 150 on the idler shaft. The compression spring urges the idler shaft toward the left, as viewed in FIG. 6, thereby urging the feed drum spindle 38 into engagement with the drive shaft 64. By moving the idler shaft 102 toward the right, as viewed in FIG. 6, against the urging of the spring 148, the feed drum 36 and spindle 38 may be removed from the machine. However, to prevent such movement of the idler shaft during operation of the machine 10, a pivoting thrust block 158, which is pivotally attached to the bolster 12, is arranged to abut the end cap 146, as shown in FIG. 2. When the feed drum 36 is in place and the thrust block 158 pivoted into its closed position, as shown in FIG. 2, there is substantially no axial play along the drive shaft 64, the feed drum spindle 38, and the idler shaft 102. Because the uprights 56, 58, 60, and 62 are all rigidly keyed to the pivot shaft 50, the drive shaft assembly 40, idler shaft assembly 42, and the feed drum and spindle 36 are free to pivot, as a unit, in the directions of the arrows 160, 162 as the pivot shaft pivots within the pillow blocks 52, as shown in FIG. 5.

Figure 11:
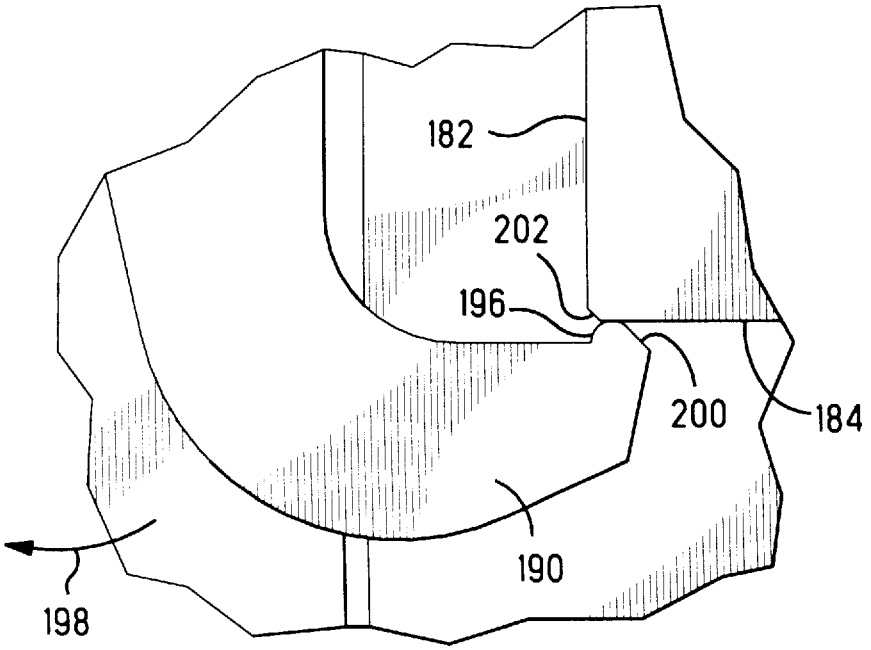
FIG. 11 is an enlarged view of a portion of the sear shown in FIG. 3.

A feed release mechanism, as best seen in FIGS. 3 and 5, includes a mounting block 164 rigidly attached to the bolster 12 by means of screws 166 that extend through clearance holes in the mounting block and into threaded holes in the bolster. An actuating stud 168 having an enlarged head 170 is supported in a slip fit hole 172 formed in the mounting block 164 substantially parallel to the bolster 12. The enlarged head 170 is in abutting engagement with a surface 176 of the upright 58. The stud 168 extends through a compression spring 174 that extends between the enlarged head 170 and the mounting block 164 so that the stud is urged toward the right against the surface 176, as viewed in FIG. 5, thereby urging the upright 58 to pivot in the direction of the arrow 162. The actuating stud 168 includes a threaded end 178 of reduced diameter that extends through a clearance hole 180 in the mounting block 164 for a purpose that will be explained. As best seen in FIGS. 3 and 5, the upright 58 includes a catch 182 projecting upwardly therefrom having a catch surface 184 facing somewhat in the direction of the arrow 162. A first sear 190 is pivotally attached to the mounting block 164 by means of a shoulder screw 192 and washer 194, the screw extending into a threaded hole in the mounting block. As best seen in FIGS. 3 and 11, the first sear 190 includes a radiused contact end 196 that is in engagement with the catch surface 184 thereby holding the upright 58 in the position shown in FIG. 5 against the urging of the compression spring 174. In this position the feed drum 36 is in feeding engagement with the strip of material 32. The radiused contact end 196 terminates in a camming surface 200 that is angled similarly to a chamfer 202 formed on the corner of the catch 182, as shown in FIG. 11. If the first sear 190 is pivoted clockwise in the direction of the arrow 198, as viewed in FIGS. 3 and 11, the radiused end 196 slides over the chamfer 202 which then rides along the camming surface, causing the first sear to further pivot clockwise. The upright 58 and the entire feed drum 36 and drive shaft and idler shaft assemblies pivot clockwise in the direction of the arrow 162, under the urging of the spring 174, to the position shown in phantom lines in FIG. 5, where the feed drum is disengaged from the strip of material 32. The compression spring 174 exerts a large enough force to rapidly accelerate the upright 58 so that when the first sear is pivoted in the direction of the arrow 198, there is substantial force causing the feed drum 36 to immediately disengage from the strip of material 32. Once this occurs, in order to move the feed drum back into feeding engagement with the strip of material, a nut 206, shown in phantom lines in FIG. 5, is threaded onto the threaded end 178 of the stud 180 and tightened against the mounting block 164 thereby easily compressing the compression spring 174. When the spring is sufficiently compressed the feed mechanism 30 is pivoted in the direction of the arrow 160 until the radiused end 196 of the first sear 190 latchingly engages the catch surface 184. The nut 206 is then removed or backed off sufficiently to allow proper operation of the release mechanism as described above. The first sear 190 includes an upwardly turned tab 208 that is used to urge the first sear in the direction of the arrow 198, as will be explained.

Figure 8:
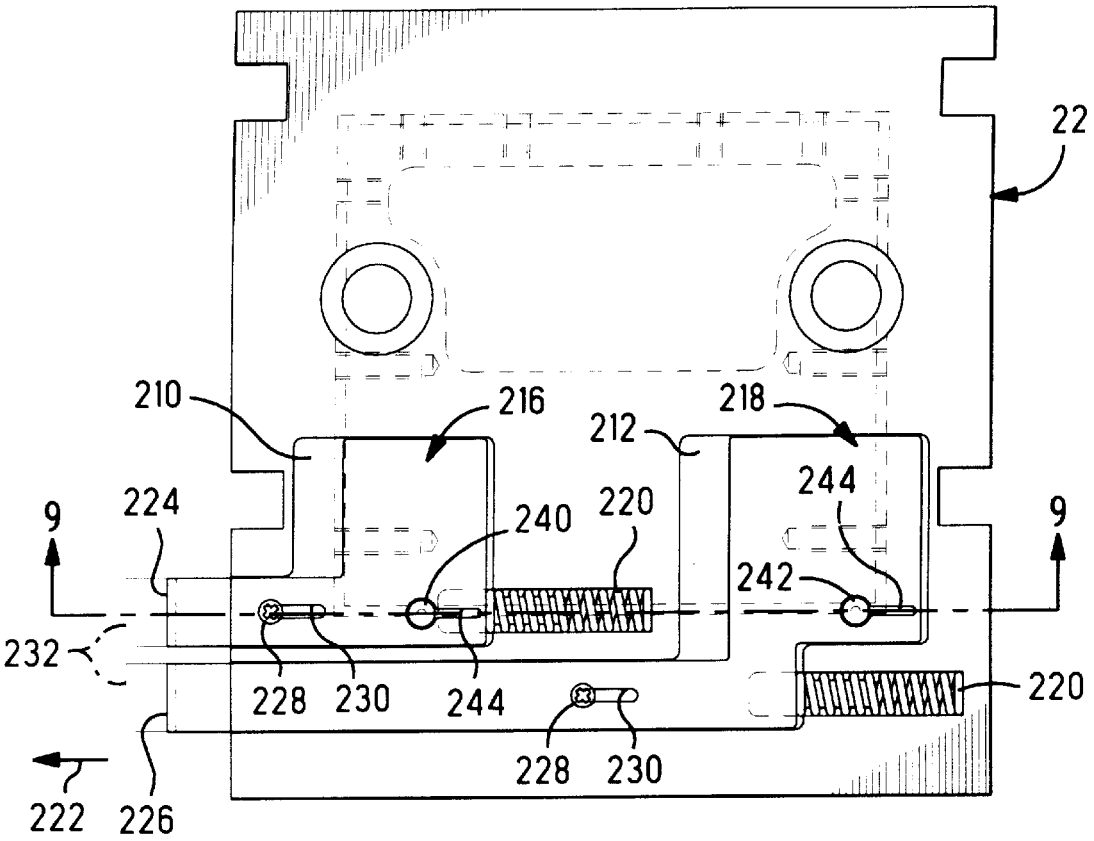
FIG. 8 is a cross-sectional view taken along the lines 8—8 in FIG. 2 showing the sear trip members.
Figure 9:
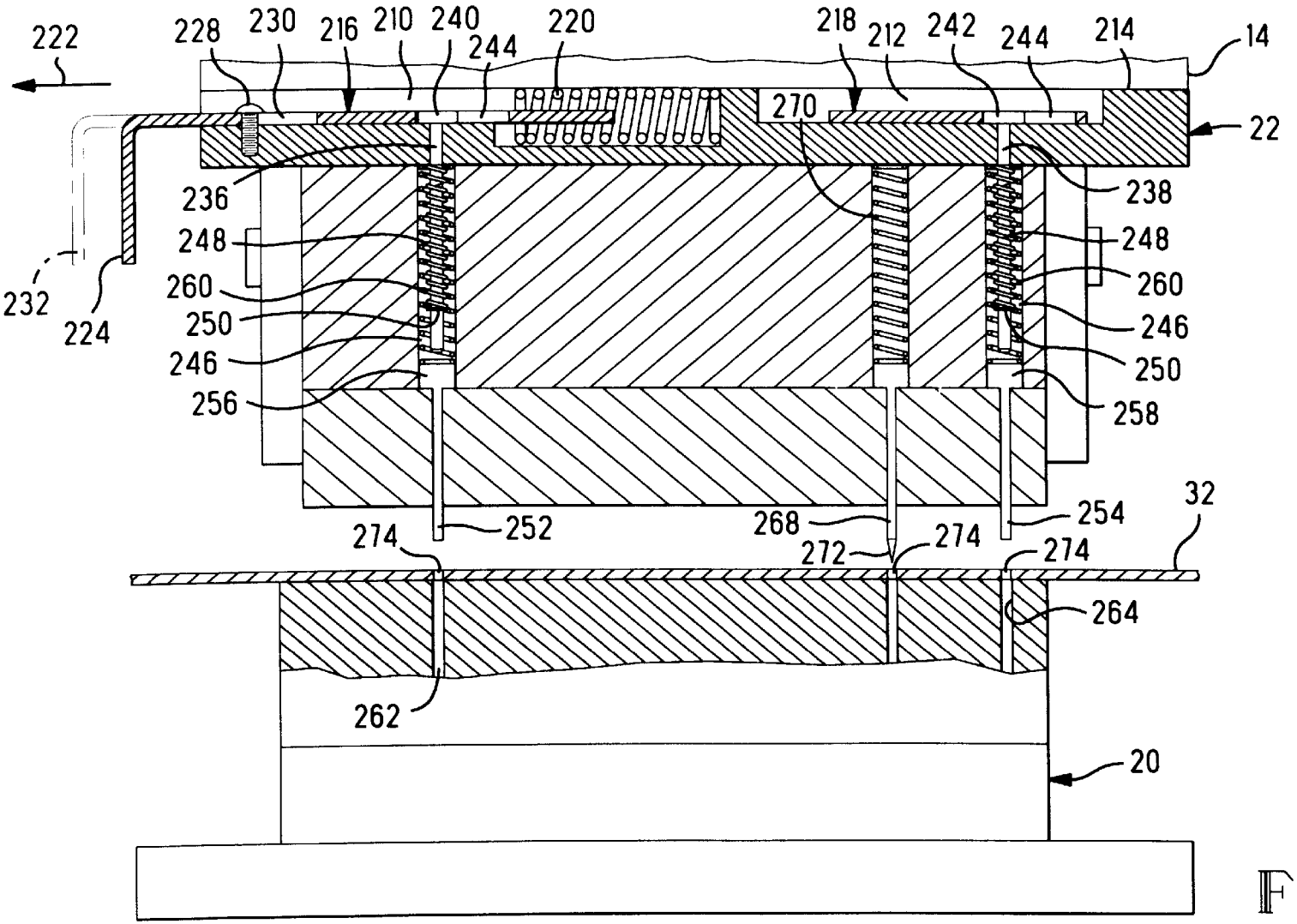
FIG. 9 is a cross-sectional view taken along the lines 9—9 in FIG. 8 showing the sear trip members.
Figure 10:
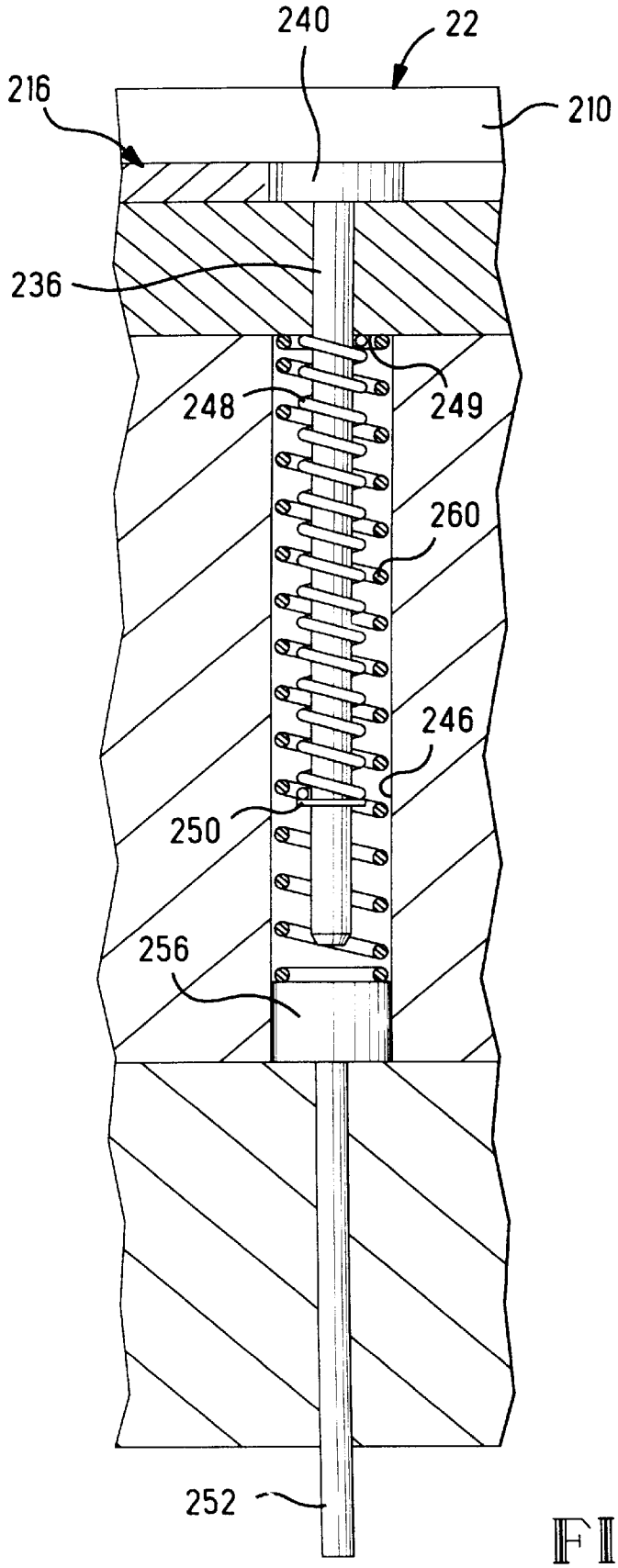
FIG. 10 is an enlarged view of one of the sensing pins shown in FIG. 9.

As best seen in FIGS. 8, 9, and 10, the upper tooling module 22 includes first and second recesses 210 and 212, respectively, formed in its upper surface 214. A second sear 216 is slidingly disposed within the first recess 210 and a third sear 218 is slidingly disposed in the second recess 212. Each of the second and third sears 216 and 218 has a compression spring 220 positioned within its respective recess 210 and 212 that urges the sear toward the left in the direction of the arrow 222, as shown in FIG. 8. The second sear 216 includes a downwardly turned second tab 224 while the third sear 218 includes a downwardly turned third tab 226. Both tabs 224 and 226 extend downwardly sufficiently far to extend vertically past at least a portion of the upwardly turned tab 208, as viewed in FIG. 2, so that movement of either of the second or third sears in the direction of the arrow 222 will cause its respective tab 224 or 226 to abuttingly engaged the tab 208. Each of the second and third sears 216 and 218 is held in its respective recess by means of a screw 228 that extends through an elongated hole 230 formed in the sear and into a threaded hole in the upper tooling module 22. Under the urging of the springs 220 the second and third sears will move toward the left, in the direction of the arrow 222 to the position shown in phantom lines 232, shown in FIGS. 8 and 9, which is sufficiently far to engage the upwardly turned tab 208 and to pivot the first sear 190 in the direction 198, as viewed in FIG. 3, so that the radiused end 196 disengages the catch surface 184 allowing the feed mechanism 30 to pivot outwardly to its disengaged position 204 shown in FIG. 5. Such movement of either the second or third sear is sufficient to trip the first sear thereby causing the feed drum 36 to disengage the strip of material 32. The second and third sears 216 and 218 are held in their positions shown in solid lines in FIGS. 8 and 9 by means of trip pins 236 and 238 having enlarged heads 240 and 242, respectively. The head 240 is positioned in a clearance keyhole opening 244 formed in the second sear 216 and the head 242 is similarly positioned in a clearance keyhole opening 246 formed in the third sear 218. Each of the trip pins 236 and 238 extends downwardly into enlarged holes 246 formed in the upper tooling module 22. A compression spring 248 is disposed on each trip pin, as best seen in FIGS. 9 and 10, one end being against a shoulder 249 in the upper tooling module and the other end against a retaining ring 250 arranged in a groove in the trip pin so that the heads 240 and 242 of each trip pin are urged downwardly against the floor of its respective recess 210 and 212. Sensing pins 252 and 254 having enlarged heads 256 and 258, respectively, are arranged in the upper tooling module 22 in alignment with the trip pins 236 and 238, respectively. The enlarged heads 256 and 258 are in their respective holes 246 with a compression spring 260 disposed between the shoulder 249 and each head so that the sensing pins 252 and 254 are urged downwardly to their positions shown in FIG. 9. The lower tooling module 20 includes clearance holes 262 and 264 in alignment with the sensing pins 252 and 254, respectively, for receiving the sensing pins when the ram 14 moves the upper tooling module 22 into mated engagement with the lower tooling module, as will be explained. A pilot pin 268, as best seen in FIG. 9, is arranged in the upper tooling module in the usual manner and is spring loaded downwardly by means of the spring 270. The pilot pin has a tapered end 272 for engaging a pilot hole 274 in the strip of material 32 and accurately positioning the strip just before the upper tooling engages the lower tooling, in the usual manner. As will be explained below, these pilot holes may be sensed by the sensing pins 252 and 254 to determine whether or not a misfeed has occurred.

Figure 4:
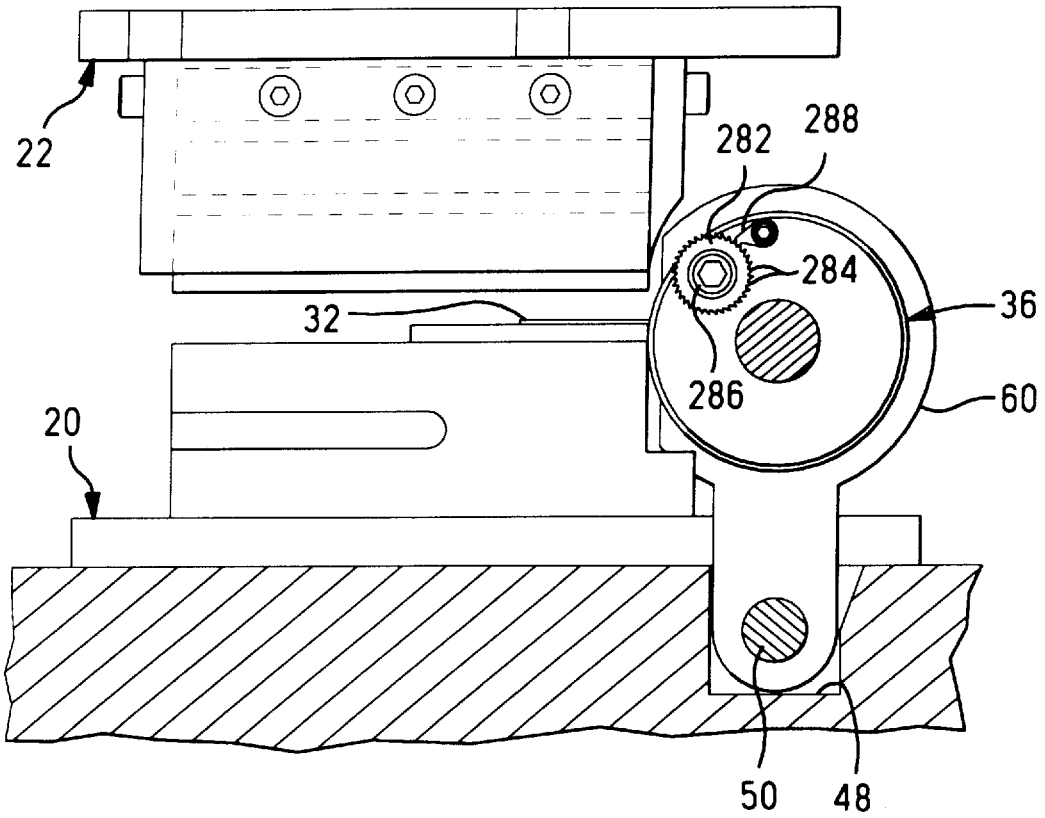
FIG. 4 is a cross-sectional view taken along the lines 4—4 in FIG. 2.
Figure 12:
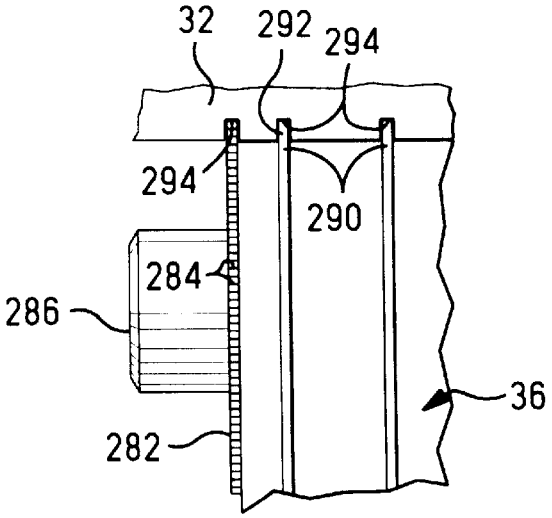
FIG. 12 is an enlarged view of a left portion of the feed drum, as viewed in FIG. 3, showing a portion of the strip of material in feeding engagement therewith.

The feed drum 36 includes a cutter disk 282 having several sharp cutting edges 284 formed on its periphery edge, as shown in FIG. 4. The cutter disk 282 is secured to the end of the feed drum 36 by means of a shoulder screw 286 that extends through a slip fit hole in the cutter disk and into a threaded hole in the feed drum. The cutter disk is free to rotate on the shoulder screw, however, a pawl 288 that is pivotally attached to the feed drum adjacent the cutter disk prevents rotation of the cutter disk. As the feed drum rotates counterclockwise, as viewed in FIG. 4, the cutter disk 282 is carried along with the feed drum. The cutter disk is positioned so that one of its cutting edges engages the strip of material 32 and forms a notch 294 therein for every revolution of the feed drum 36 thereby creating a series of spaced notches 294 in the edge of the strip of material, as shown in FIG. 12. When a cutting edge becomes dull the disk is simply rotated one position so that the next cutting edge is brought into cutting position. Again, the pawl 288 will prevent rotation so that the new edge will now form the notches 294 as the feed drum rotates. As best seen in FIG. 2, the feed drum 36 includes a single continuous feed track 290 that projects outwardly from the outer cylindrical surface of the feed drum and runs substantially the entire length of the feed drum, resulting in a series of spaced helical segments, all of which are part of the single continuous feed track 290. The feed track 290 has a width that is slightly smaller that the width of the notch 294 formed in the edge of the strip of material by the cutter disk 282. The pitch of the feed track exactly matches the spacing of the notches 294 formed along the edge of the strip of material so that as the feed drum rotates counterclockwise, as viewed in FIG. 4, a leading end 292 of the feed track 290 enters the next newly formed notch 294 while the strip of material 32 moves toward the right, as viewed in FIGS. 2 and 12. The feed track 290 is formed on the feed drum 36 in such a way that actual feeding of the strip of material 32 occurs only during a relatively small portion 296 of each rotation of the feed drum, as shown in FIG. 2. This portion of rotation occurs while the pilot pin 268 is not engaged in the hole 274 of the strip 32. The remaining portion of each revolution is a null period with respect to feeding of the strip of material and is the portion of the operating cycle of the machine that the stamping and forming operations are performed. This is accomplished by maintaining the helical segments of the feed track 290 substantially perpendicular to the axis of the feed drum except for the portions indicated at 296 in FIG. 2 where the feed track progressively advances toward the right. With this arrangement the strip of material is advanced toward the right, as viewed in FIG. 2, only during the portion of each rotation of the feed drum when the track portions 296 are in engagement with the notches 294. It will be understood that the feed track 290 engages the notches 294 of the strip of material 32 along a length that is substantially the width of the upper and lower tooling modules 22 and 24, as shown in FIG. 3, thereby providing a continuous feed force on the strip over this length. This helps to prevent buckling of the strip of material 32 within the tooling modules.

The operation of the feed release mechanism will now be described with reference to FIGS. 2, 4, 5, and 8 through 10. It will be assumed that the feed drum 36 is in the position shown in solid lines in FIG. 4 in engagement with the strip of material 32 and that the machine is currently performing stamping and forming operations on the strip. It will be understood that a series of accurately spaced pilot holes 274 are already properly formed in the strip of material 32 and that the two sensing pins 252 and 254 are positioned to be in vertical alignment with respective ones of these pilot pin holes when the ram moves the upper tooling module 22 downwardly into engagement with the lower tooling module 20. In such case the sensing pins 252 and 254 simply enter into the pilot pin holes 274 and the clearance holes 264 in the lower tooling module 20 and the operating cycle continues uninterrupted. In the event that a misfeed occurs, that is, the strip of material is not positioned within the tooling so that a pilot pin hole 274 is not in alignment with each sensing pin 252 and 254, when the upper tooling module descends sufficiently far, the sensing pin not in alignment with a pilot pin hole will engage the strip of material. As the upper tooling continues to descend the sensing pin 252, 254 will not move further so that the spring 260 compresses and the respective trip pin 236, 238 engages the head 256, 258 causing the trip pin to stop its downward motion while the upper tooling module continues downwardly. This causes the head 240, 242 of the trip pin to disengage its respective keyhole opening 244 so that the head is now in the space of the recess 210, 212 above the second or third sear 216 or 218, as viewed in FIG. 9. When this occurs, the sear is now free to move under the urging of the spring 220 in the direction of the arrow 222 into abutting engagement with the tab 208 of the first sear 190. The first sear 190 is thereby pivoted in the direction of the arrow 198 so that the radiused end 196 disengages the catch surface 184, allowing the heavy compression spring 174 to pivot the feed drum 36 in the direction of the arrow 162, shown in FIG. 5, out of feeding engagement with the strip of material 32. The feed drum 36 begins moving out of feeding engagement with the strip of material substantially immediately upon one of the sensing pins engaging the strip of material instead of entering a pilot hole 274. The only delay is the small amount of time required for the second and third sears to react to the urging of their respective springs. This reaction time is minimized by making the moving parts out of relatively light materials such as aluminum and titanium, where possible, to reduce the amount a mass that must be moved.

While the sensing pins 252 and 254, in the present example, are aligned with the pilot pin holes 274 for the purpose of detecting a misfeed, it will be understood that other suitable openings in the strip of material 32 may be used for this purpose.

An important advantage of the present invention is that the feed mechanism has a release system that when a misfeed is detected it immediately disengages from the strip of material being operated upon thereby minimizing potential damage to the tooling and the machine. Additionally, since the misfeed detection and feed release systems operate with very little delay, usually prior to the completion of a single machine cycle, the present invention is especially useful in high speed stamping and forming machines where serious damage can occur in an extremely short time period after a misfeed occurs.

I claim:

1. In a stamping and forming machine having a frame, a bolster plate attached to said frame, a ram arranged for reciprocating motion within said frame in a first direction toward said bolster plate and in a second direction away therefrom, including tooling having a first tool module attached to said ram and a second tool module attached to said bolster matable with said first tool module for performing a stamping and forming operation on a strip of material upon movement of said ram in said first direction, a feed mechanism for incrementally feeding said strip of material along a feed path and in a proper position within said tooling, said feed system including a drive member coupled to said frame and arranged to move between a driving position where said drive member is in engagement with said strip of material for effecting said movement thereof along said feed path and a remote position out of said engagement, and a misfeed detection and feed release mechanism for moving said feed member from said driving position to said remote position upon detection of a misfeed where said strip of material is displaced from said proper position, comprising:

(a) resilient means for urging said drive member toward said remote position;

(b) a first sear coupled to said frame and movable between a first position in coupled engagement with said drive member so that said drive member is held in said driving position against the urging of said resilient means and, a first tripped position where said first sear is out of said coupled engagement with said drive member so that said drive member is free to move toward said remote position under the urging of said resilient means; and (c) a second sear coupled to said upper tooling module and movable from a second position spaced from said first sear to a second tripped position wherein said second sear abuttingly engages and moves said first sear to said first tripped position only upon detection of said misfeed.

2. The machine according to claim 1 including a second resilient means coupled to said upper tooling module for urging said second sear toward said second tripped position.

3. The machine according to claim 2 including a sensing member having a catch, movable from a first sensing position in holding engagement with said second sear wherein said second sear is held in said second position, to a second sensing position when a said misfeed is detected by said sensing member.

4. The machine according to claim 3 wherein said sensing member is a pin and said catch is an enlarged head on said pin, said pin positioned to enter a specific opening in said strip of material when said ram is moved in said first direction and said strip of material is in said proper position.

5. The machine according to claim 4 wherein said sensing member is arranged so that when said strip of material is displaced from said proper position when said ram is moved in said first direction said sensing member engages said strip of material and moves said catch to said second sensing position.

6. The machine according to claim 5 wherein said second sear includes an opening having a wall and said head of said sensing pin is in said opening against said wall when said head is in said first sensing position.

7. The machine according to claim 6 including a third resilient means coupled to said upper tooling module for urging said sensing pin into said first sensing position.

8. The machine according to claim 1 wherein said second sear is slidably arranged within said upper tooling module for sliding movement between said second position and said second tripped position.

9. The machine according to claim 8 wherein said first sear includes a first flange arranged substantially parallel to the axis of pivotal motion of said first sear, said second sear positioned to abuttingly engage said first flange when said sensing pin moves from said first sensing position to said second sensing position.

10. The machine according to claim 8 wherein said second sear includes a second flange arranged substantially parallel to the axis of pivotal motion of said first sear, said second sear positioned so that said second flange abuttingly engages said first sear when said sensing pin moves from said first sensing position to said second sensing position.

11. The machine according to claim 1 wherein said first sear is pivotally attached to said frame and said movement between said first position and said first tripped position is pivotal movement.

12. The machine according to claim 1 wherein said drive member is a cylindrical drum having a generally helical track disposed along the outer periphery thereof for drivingly engaging notches spaced in and along said strip of material, and feeding said strip of material upon rotation of said drum.

13. The machine according to claim 12 wherein said drive member includes a cutting member attached to said drum and arranged to form one of said notches upon every single rotation of said drum.

14. The machine according to claim 13 wherein said cutting member includes a plurality of cutting edges, each of which can be individually positioned to effect said forming of one of said notches.

15. The machine according to claim 14 wherein said cutting member is disk-shaped having a peripheral edge, said plurality of cutting edges being arranged along said peripheral edge, each of said cutting edges being individually positioned by rotation of said cutting member in a first rotational direction.

16. The machine according to claim 15 including a pawl pivotally attached to said drum, said pawl being in engagement with said cutting member and arranged to prevent rotation of said cutting member in a direction opposite said first rotational direction.

17. The machine according to claim 12 wherein said track includes a null portion that momentarily discontinues said feeding of said strip of material for a portion of said rotation of said drum.

18. The machine according to claim 1 wherein said drive member is a cylindrically shaped drum having a spindle extending along its longitudinal axis, one end of said spindle drivingly coupled to and supported by a drive shaft and the other end of said spindle supported by an idler shaft, said drive shaft and idler shaft journaled for rotation in first and second support members, respectively.

19. The machine according to claim 18 including a pivot shaft journaled for pivotal movement in said machine, wherein said first and second support members are rigidly attached to said pivot shaft so that when said drive member moves toward said second position said first and second support members and said pivot shaft pivot in one direction and when said drive member moves toward said first position said first and second support members and said pivot shaft pivot in a direction opposite to said one direction.

20. The machine according to claim 19 wherein said first sear includes a sear end and wherein said coupled engagement of said first sear to said drive member is effected by said sear end engaging a first surface of one of said first and second support members.

21. The machine according to claim 20 wherein said resilient means for urging said drive member toward said second position comprises a compression spring attached to said frame and in pushing engagement with said one of said first and second support members.

22. In a stamping and forming machine having a frame, a bolster plate attached to said frame, a ram arranged for reciprocating motion within said frame in a first direction toward said bolster plate and in a second direction away therefrom, including tooling having a first tool module attached to said ram and a second tool module attached to said bolster matable with said first tool module for performing a stamping and forming operation on a strip of material upon movement of said ram in said first direction, a feed mechanism for incrementally feeding said strip of material along a feed path and in a proper position within said tooling, said feed system including a drive member coupled to said frame and arranged to move between a driving position where said drive member is in engagement with said strip of material for effecting said movement thereof along said feed path and a remote position out of said engagement, and a misfeed detection and feed release mechanism for moving said feed member from said driving position to said remote position upon detection of a misfeed where said strip of material is displaced from said proper position, including resilient means for urging said drive member toward said remote position, wherein said drive member is a cylindrically shaped drum having a spindle extending along its longitudinal axis, one end of said spindle drivingly coupled to and supported by a drive shaft and the other end of said spindle supported by an idler shaft, said drive shaft and idler shaft journaled for rotation in first and second support members, respectively.

23. The machine according to claim 22 including a pivot shaft journaled for pivotal movement in said machine, wherein said first and second support members are rigidly attached to said pivot shaft so that when said drive member moves toward said second position said first and second support members and pivot shaft pivot in one direction and when said drive member moves toward said first position said first and second support members and pivot shaft pivot in a direction opposite to said one direction.

24. The machine according to claim 22 wherein said resilient means for urging said drive member toward said second position comprises a compression spring attached to said frame and in pushing engagement with said one of said first and second support members.

* * * * *